US011325229B2

(12) United States Patent
Zhang

(10) Patent No.: US 11,325,229 B2
(45) Date of Patent: May 10, 2022

(54) SOCKET AND WRENCH THEREFOR

(71) Applicant: Kai Zhang, Zhangjiagang (CN)

(72) Inventor: Kai Zhang, Zhangjiagang (CN)

( * ) Notice: Subject to any disclaimer, the term of this patent is extended or adjusted under 35 U.S.C. 154(b) by 299 days.

(21) Appl. No.: 16/695,204

(22) Filed: Nov. 26, 2019

(65) Prior Publication Data

US 2021/0046626 A1 Feb. 18, 2021

(51) Int. Cl.
*B25B 23/00* (2006.01)
*B25B 13/46* (2006.01)
*B25B 13/08* (2006.01)

(52) U.S. Cl.
CPC ..... *B25B 23/0035* (2013.01); *B25B 13/462* (2013.01); *B25B 13/08* (2013.01)

(58) Field of Classification Search
CPC ..... B25B 13/06; B25B 13/065; B25B 13/005; B25B 13/04; B25B 13/48; B25B 13/56; B25B 23/0035
See application file for complete search history.

(56) References Cited

U.S. PATENT DOCUMENTS 8,459,151 B2 * 6/2013 Wang ..... B25B 13/463 81/63.2
9,156,141 B2 * 10/2015 Chang ..... B25B 13/06
9,849,569 B2 * 12/2017 Su ..... B25B 13/06
10,040,177 B2 * 8/2018 Liu ..... B25B 13/463
10,792,791 B2 * 10/2020 Su ..... B25B 13/468
2016/0271760 A1 * 9/2016 Hu ..... B25B 13/56
2017/0209991 A1 * 7/2017 Lee ..... B25B 23/0028
2017/0291287 A1 * 10/2017 Bendix ..... B25B 13/481
2020/0282527 A1 * 9/2020 Shih ..... B25B 13/461
2021/0129296 A1 * 5/2021 Li ..... B25B 13/065

* cited by examiner

*Primary Examiner* — David B. Thomas
(74) *Attorney, Agent, or Firm* — Raymond Chan

(57) ABSTRACT

An assembly of a wrench and a socket. The wrench has a penetrating driving hole, which has a retaining ring mounted therein. The socket, having a front end and a tail end, comprises a socketing portion axially extended between the front end and the tail end thereof for driving a fastening element. The socket comprises a retaining portion formed on the periphery thereof. The retaining portion has a retaining groove arranged at retaining corners radially indented for matching the retaining ring. The retaining groove is positioned between the front end and the tail end. The retaining portion further has a buffer groove formed between the retaining groove and the front end, so as to allow the buffer groove to successively provide a buffer or damping effect with the retaining ring when the retaining groove is decoupled from the retaining ring. Accordingly, the user is allowed to control his/her force more easily and improves the operational safety for the process of pulling out of the socket.

12 Claims, 5 Drawing Sheets

SOCKET AND WRENCH THEREFOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention innovatively provides a technology that helps to reduce the risk of accident rendered by overly and forcibly pulling out a socket.

Description of Related Arts

It is noted that according to a conventional technology as illustrated in U.S. Pat. No. 9,156,141, entitled "Adaptor for wrench device", a wrench as disclosed is capable of matching various sizes of hexagonal fastening units, such as nut or bolt head, of by changing different sockets, so as to effectively connect or fasten mechanical structures or construction components.

Nevertheless, during the process of changing socket for the wrench, the current socket must be firstly pulled out from the driving hole of the wrench, while there is a retaining ring arranged in the driving hole to restrict the current socket from decoupling from the retaining groove. Therefore, as the user would like to pull out the current socket, he or she has to forcefully exert a force that is great enough to flexibly distort the retaining ring to release the engagement with the retaining groove of the socket. Because it is difficult to control the amount of force to apply, especially when there is oil or grease stain attached around the socket and the retaining ring, it is so often that the user exerts too much force in pulling out the socket, resulting in failing to hold on and dropping the socket. Moreover, some users may even accidentally strain their muscles or get hurt due to collision with adjacent objects because of exerting too much force to pull out the socket.

SUMMARY OF THE PRESENT INVENTION

In view of the above drawbacks of the conventional socket wrench, the present invention provides a socket and a wrench therefor, which have simple structure and high reliability while being capable of providing buffering function.

The present invention mainly provides a socket that solves the above mentioned conventional drawbacks. The socket has a front end and an opposing tail end and comprises a through socketing portion extended axially for driving a fastening element. The socket comprises a polygonal retaining portion formed peripherally, wherein the retaining portion has a plurality of retaining surfaces and a retaining corner is formed between every two adjacent retaining surfaces. A retaining groove is radially indented at each of the retaining corners and positioned between the front end and the tail end of the socket. The retaining portion further has a buffer groove formed between the retaining groove and the front end so as to allow the buffer groove to successively provide a buffering or damping effect with the retaining ring when the retaining groove is decoupled from the retaining ring inside of the wrench, so as to prevent accident generated while the user fails to control his or her operation force properly.

Preferably, when the retaining groove of the socket is coupled with the retaining ring inside the wrench, the front end of the socket is arranged to be protruded from the wrench for a predetermined distance, such that the user is able to force the retaining groove detached from the retaining ring simply by pushing the front end of the socket with a reverse force, that greatly facilitates the user to pull out the socket from the wrench conveniently.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
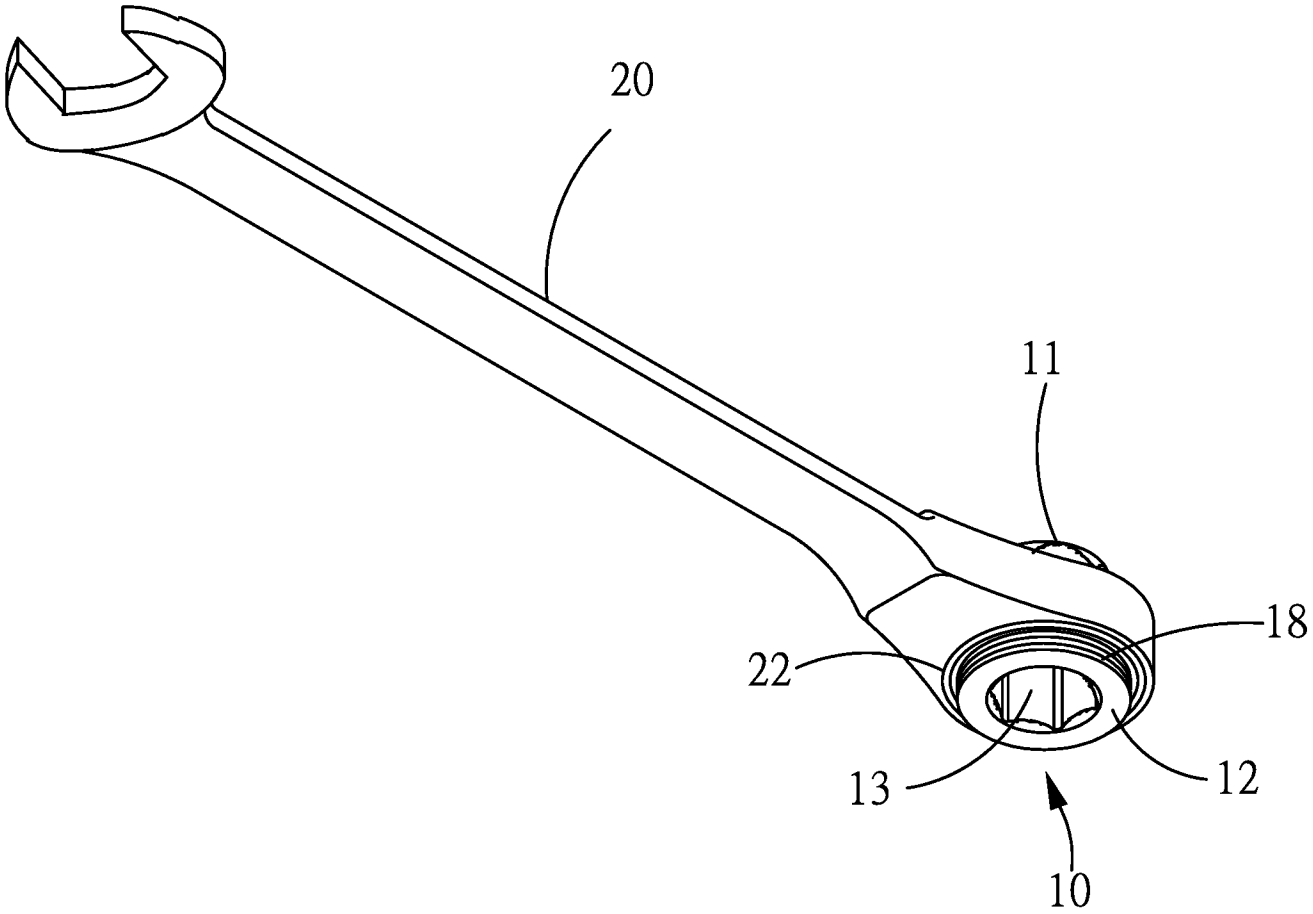
FIG. 1 is a perspective view illustrating a socket assembled with a wrench according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1-5, the present invention provides a socket 10 and a wrench 20 configured to be assembled with the socket 10.

In which, the socket 10, which has a hollow pillar shape, has a front end 11 and an opposing tail end 12 and comprises a through socketing portion 13 axially extended between the front end 11 and the tail end 12 forming a central socket hole. The socketing portion 13 has a polygonal through hole defining even number of retaining corners, which may be, for example, a regular hexagonal shape as illustrated in the drawings or alternatively a regular tetragonal shape or regular hexagonal plum shape, as long as it is capable of driving a fastening element, such as a hexagonal nut or a bolt head (not shown in figures).

The socket 10 comprises a polygonal retaining portion 14 formed peripherally, wherein the retaining portion 14 has a regular polygonal sectional shape defining a plurality of retaining surfaces. One end of the retaining portion 14 is perpendicularly intersected with the front end 11 of the socket 10 to define an intersection position where a chamfer 15 is formed for guiding the retaining portion 14 to be axially and detachably coupled with a driving hole 23 of the wrench 20. The retaining portion 14 may has a regular hexagonal shape as illustrated in the figures or other regular polygonal shape, as long as it allows the retaining portion 14 to be axially installed into and detached from the driving hole 23 while preventing the socket 10 from self rotating with respect to the wrench 20.

The retaining portion 14 of the socket 10 has a retaining groove 16 radially indented at each of the retaining corners thereof. The retaining groove 16 is located between the front end 11 and the tail end 12. The retaining portion 14 also has at least one buffer groove 17 radially indented at each of the retaining corners and positioned between the retaining groove 16 and the front end 11. As shown in the drawings, there are three buffer grooves 17 each having a sectional V-shape so as to form a serrated surface at each of the retaining corners of the retaining portion 14, wherein a depth D1 of the buffer groove 17 is shallower than a depth D2 of the retaining groove 16. Nevertheless, the above quantity and depth D1 of the buffer groove 17 are just for embodying the present invention, which shall not limit the implementation of the buffer groove 17.

Figure 2:
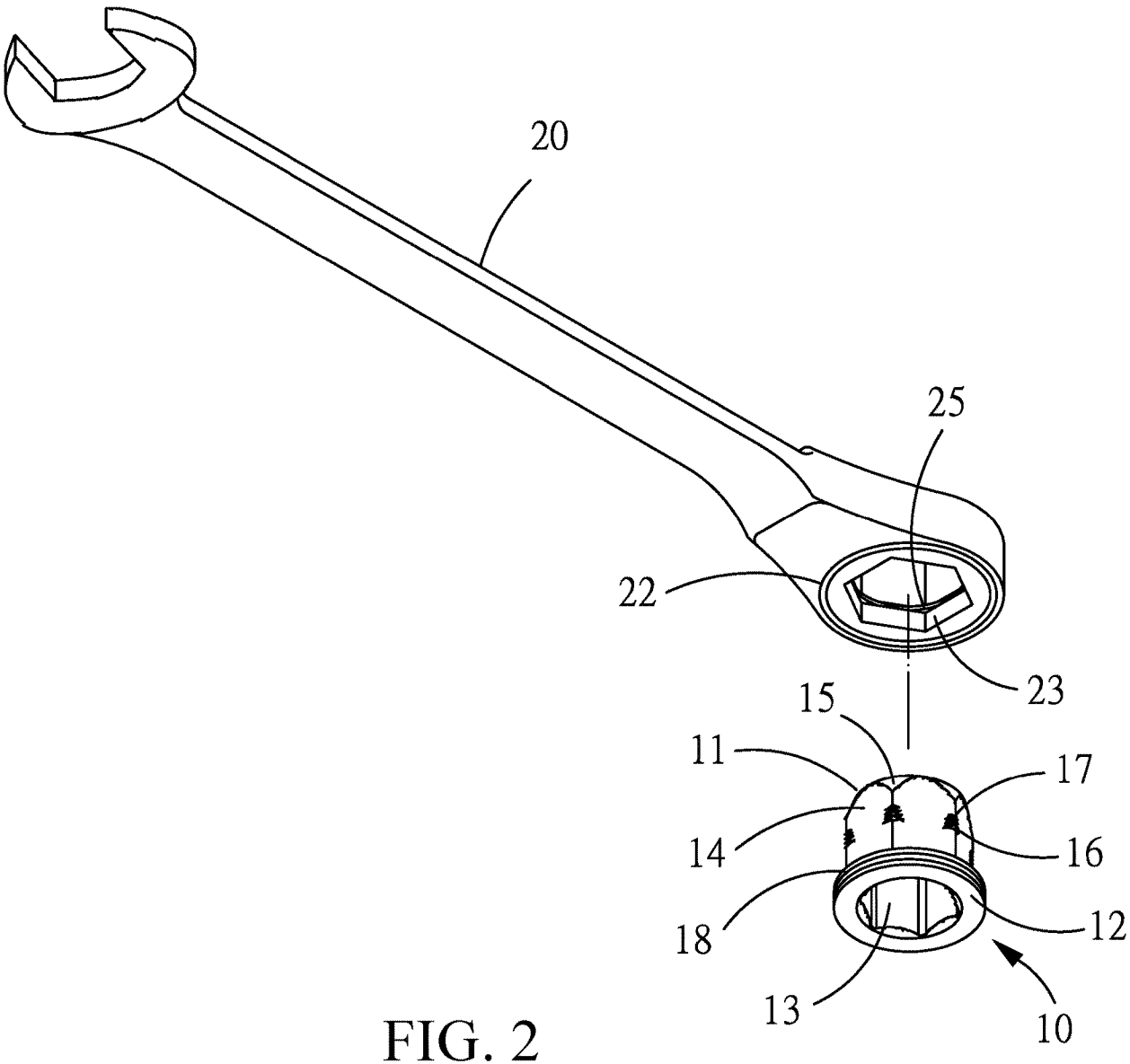
FIG. 2 is an exploded view illustrating the socket and the wrench therefor according to the above preferred embodiment of the present invention.
Figure 3:
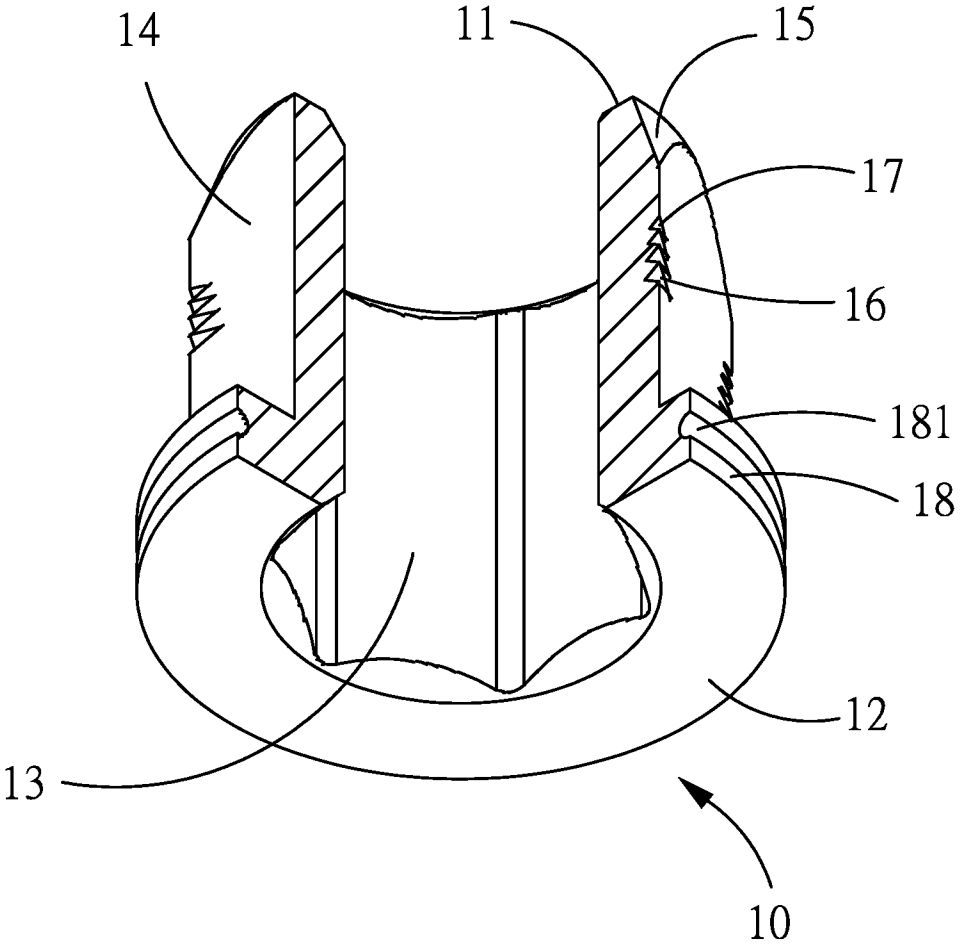
FIG. 3 is a partial sectional view illustrating the socket according to the above preferred embodiment of the present invention.
Figure 4:
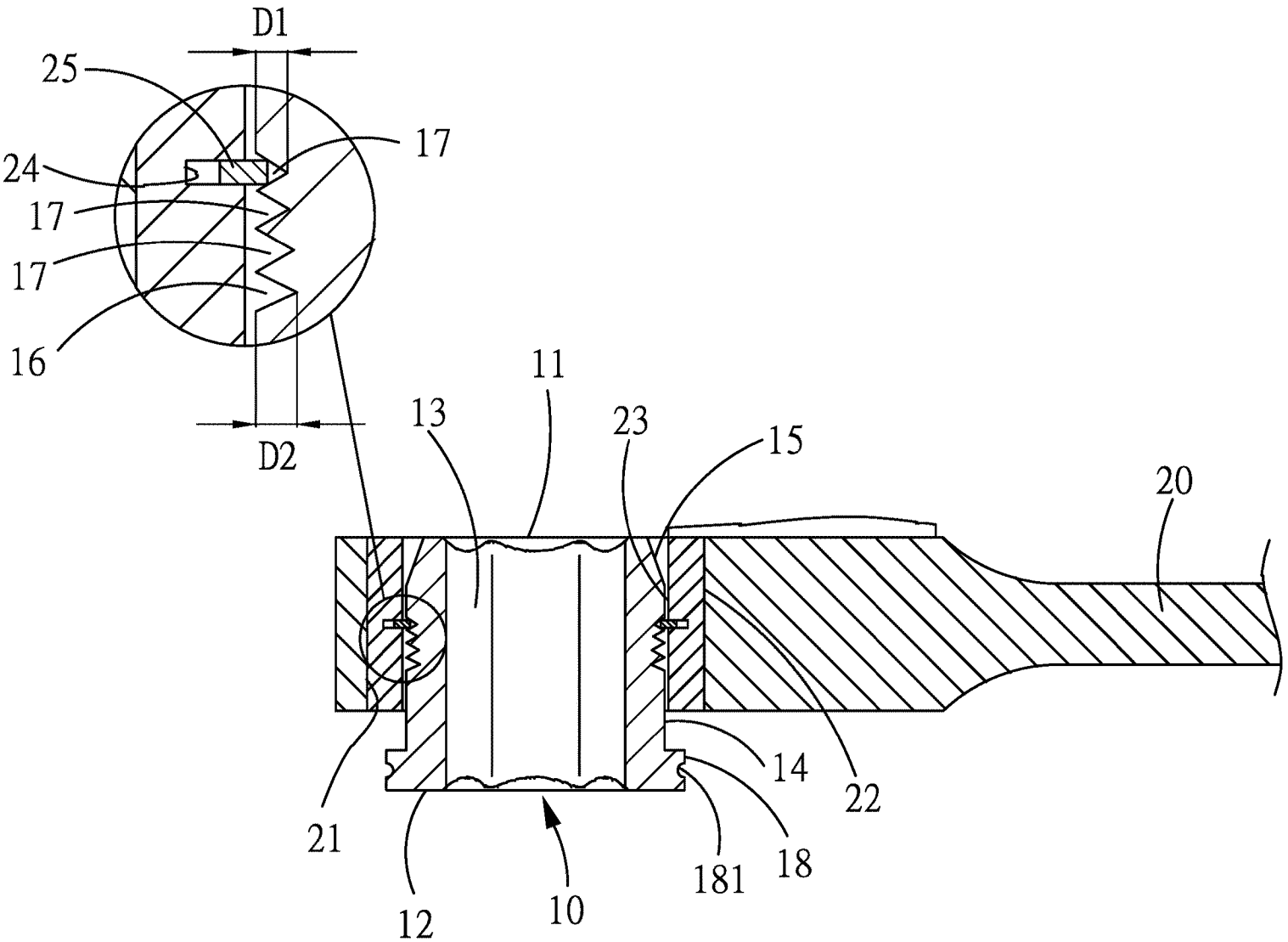
FIG. 4 is a sectional view illustrating a buffer effect provided by a buffer groove and a retaining ring according to the above preferred embodiment of the present invention.
Figure 5:
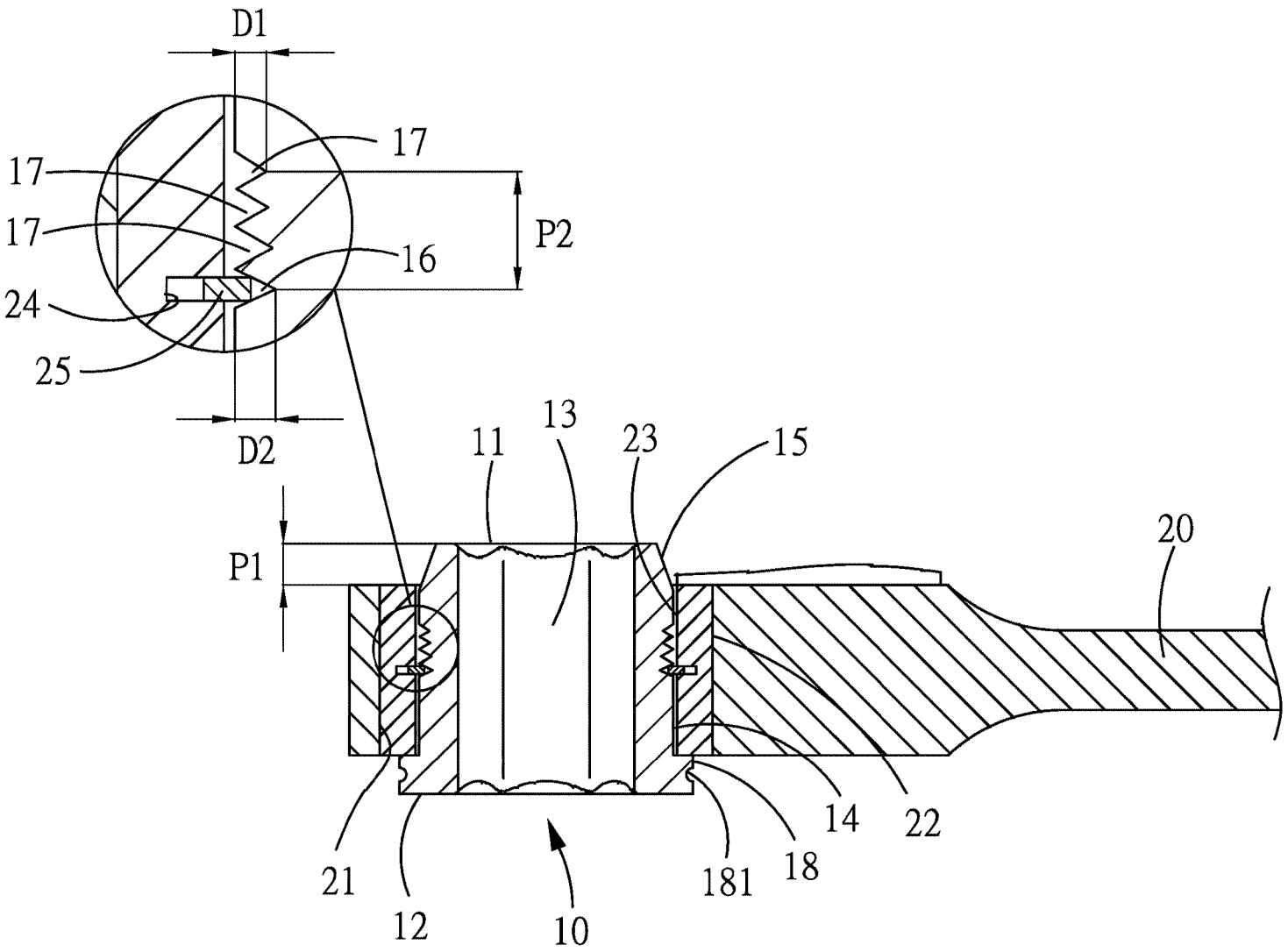
FIG. 5 is a sectional view illustrating a positioning effect provided by a retaining groove and a retaining ring according to the above preferred embodiment of the present invention.

Referring to FIGS. 2, 4, and 5, the wrench 20 has a through hole 21 penetrating through both ends thereof so as to allow an unidirectionally rotatable ratchet wheel 22 to be mounted therein. The ratchet wheel 22 has a central driving hole 23 penetrating therethrough. The shape of the driving hole 23 matches the shape of the retaining portion 14 correspondingly, so as to allow the user to insert the front end 11 of the socket 10 into the driving hole 23, wherein the chamfer 15 is capable of firstly guiding the retaining portion 14 in position to ensure the retaining portion 14 coupling with the driving hole 23, so as to construct a ready-to-use ring ratchet wrench after the socket 10 being coupled with the wrench 20, allowing the user to decide to fasten or loosen a fastening element whether the socketing portion 13 facing upwards or downwards with the wrench 20.

In order to prevent the socket 10 coupled with the driving hole 23 from randomly axially decoupling, the driving hole 23 has an annular groove 24 radially indented in a middle portion thereof. The annular groove 24 is adapted for installing a retaining ring 25 which can be coupled with and decoupled from the retaining groove 16, such that when the retaining portion 14 is to be coupled with the driving hole 23, as illustrated in FIG. 4, the buffer groove 17 will firstly act with the retaining ring 25 to buffer the force exerted by the user on the socket 10. Then, when the retaining ring 25 and the retaining groove 16 match with each other, the retaining ring 25 will be buckled and positioned at the catching groove 16, so as to restrict and prevent the socket 10 from axially decoupling from the driving hole 23. Referring to FIG. 5, at this moment, the front end 11 of the socket 10 penetrated through the wrench 20 is protruded from the wrench 20 for a predetermined distance P1, such that the user is able to exert a reverse force against the front end 11 to push the front end 11 of the socket 10 moving toward the direction of the tail end 12 until the retaining groove 16 has been forced to decoupled and departed from the retaining ring 25. Then, the buffer groove 17 will, as illustrated in FIG. 4, generate a buffer or damping effect with the retaining ring 25 for effectively reducing the speed of the socket 10 decoupling from the driving hole 23, so as to prevent accident generated while the user fails to control his or her operation force property.

It is worth mentioning that, the predetermined distance P1 as mentioned above is controlled to be equal to the maximum distance P2 between the retaining groove 16 and the buffer groove 17. Accordingly, as illustrated in FIG. 4, when the buffer groove 17 and the retaining ring 25 are engaged to provide buffer or damping effect, the front end 11 of the socket 10 is approximately aligned to the top surface of the wrench 20. However, when the retaining groove 16 matches the retaining ring 25, the front end 11 of the socket 10 is protruded from the top surface of the wrench 20 for the predetermined distance P1.

According to the present invention, the socket 10 further comprises a radially enlarged head 18 at the tail end 12 thereof. The outer diameter of the head 18 is larger than a minimum hole dimension of the driving hole 23, so as to ensure the head 18 being biased against an end side of the driving hole 23. Accordingly, the socket 10 may only unidirectionally have its front end 11 entering or leaving the driving hole 23, so that when the retaining portion 14 is forced to be coupled with the driving hole 23, the buffer groove 17 and the retaining groove 16 will sequentially act with the retaining ring 25. Similarly, when the user forces the retaining portion 14 to decouple from the driving hole 23, the retaining groove 16 and the buffer groove 17 will sequentially act with the retaining ring 25, so as to forcefully reduce the speed of the socket 10 decoupling from the driving hole 23 by means of the buffer groove 17. It should be noted that the head 18 may also has at least one ring groove 181 around the periphery thereof for facilitating the user to grip and hold it for exertion.

In view of the above description, the present invention has at least the following advantages.

First, in the process of pulling out the socket 10 of the present invention, when the retaining groove 16 of the socket 10 is forced to overcome the coupling with the retaining ring 25, the socket 10 will accumulatively have a maximum momentum. Then, the buffer groove 17 of the socket 10 will successively provide a buffer or damping effect with the retaining ring 25, so as to reduce the momentum and help the user to control his/her force more easily, such that the operational safety for the process of pulling out the socket can be improved.

Second, when the retaining groove 16 of the socket 10 of the present invention is coupled with the retaining ring 25 inside of the wrench 20, the front end 11 of the socket 10 is protruded from the wrench for a predetermined distance P1, so as to facilitate the user to pull out the socket by simply pushing the front end 11 of the socket 10.

Third, the present invention provides a design that the depth D1 of the buffer groove 17 is shallower than the depth D2 of the retaining groove 16, so as to provide a texture and feeling for the engagement of the retaining ring 25 and the buffer groove 17, which is different and distinctive from that of the retaining groove 16 and the retaining ring 25. Besides of this extraordinary operation feeling, it also helps to notify and remind the user. Further, when it has more than one buffer grooves 17, it may further provide an interval buffer or damping effect.

In view of above, the overall structure and arrangement of the present invention is novel and advantageous, which is certainly a great creation of a technical construct and shall match the conditions of patent application. Therefore, it is applied herein in accordance with the law. However, what has been mentioned above is only one of the preferred embodiments of the present invention, which shall not be used to limit the scope of the practice of the present invention. In other words, all equivalent alternatives and modifications according to the claims of the present invention shall still be covered by the claimed scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A socket for a wrench, having a front end and a tail end, comprising:

a through socketing portion axially extended between the front end and the tail end for driving a fastening element, and a polygonal retaining portion formed on a peripheral of said socket, wherein said retaining portion is arranged for coupling with a driving hole of the wrench, wherein said retaining portion has a retaining groove radially indented at retaining corners located between said front end and said tail end of said socket so as for coupling with and be positioned by a retaining ring arranged in the driving hole, and a buffer groove formed between said retaining groove and said front end, so as to allow said buffer groove to successively provide a buffer effect with said retaining ring after said retaining groove is decoupled from said retaining ring.

2. The socket, as recited in claim 1, wherein said tail end of said socket comprises an enlarged head radially and outwardly at one of said front end and said tail end, wherein an outer diameter of said head is greater than a minimal hole dimension of the driving hole.

3. The socket, as recited in claim 2, wherein said head has at least one ring groove arranged on a periphery thereof.

4. The socket, as recited in claim 2, wherein a depth of said buffer groove is shallower than a depth of said retaining groove.

5. The socket, as recited in claim 4, wherein said retaining portion has one or more buffer grooves radially indented at retaining corners respectively between said retaining groove and said front end, so as to form a serrated surface at said retaining corners of said retaining portion.

6. The socket, as recited in claim 2, wherein said socket comprises a central hole-shaped socketing portion defined axially and penetrating through said front end and said tail end, which is a through hole having a regular polygon shape and even number of retaining corners, wherein an end of said retaining portion of said socket is perpendicularly intersected with said front end of said socket defining an intersection position where a chamfer is formed.

7. The socket, as recited in claim 1, wherein a depth of said buffer groove is shallower than a depth of said retaining groove.

8. The socket, as recited in claim 7, wherein said retaining portion has one or more buffer grooves radially indented at retaining corners respectively between said retaining groove and said front end, so as to form a serrated surface at said retaining corners of said retaining portion.

9. The socket, as recited in claim 1, wherein said socket comprises a central hole-shaped socketing portion defined axially and penetrating through said front end and said tail end, which is a through hole having a regular polygon shape and even number of retaining corners, wherein an end of said retaining portion of said socket is perpendicularly intersected with said front end of said socket defining an intersection position where a chamfer is formed.

10. A socket wrench, comprising:

a wrench, having a through hole perpendicularly penetrating therethrough, comprising an unidirectionally rotatable ratchet wheel mounted in said through hole, wherein said ratchet wheel has a central driving hole having a polygonal shape, wherein said driving hole has an annular groove radially indented and a retaining ring is mounted in said annular groove; and a socket, having a front end and a tail end, comprising a socketing portion axially extended between said front end and said tail end for driving a fastening element, wherein said socket comprises a retaining portion formed on a periphery thereof, wherein said retaining portion has a plurality of retaining corners and a retaining groove radially indented at said retaining corners adapted for matching said retaining ring, wherein said retaining groove is positioned between said front end and said tail end, wherein said retaining portion further has a buffer groove formed between said retaining groove and said front end, such that said buffer groove is arranged to successively provide a buffer effect with said retaining ring when said retaining groove is decoupled from said retaining ring.

11. The socket wrench, as recited in claim 10, wherein when said retaining ring is buckled and positioned at said retaining groove, said front end is protruded from said wrench for a predetermined distance.

12. The socket wrench, as recited in claim 11, wherein the predetermined distance is equal to a maximum distance between said retaining groove and said buffer groove, wherein said front end of said socket is aligned to said wrench when said buffer groove and said retaining ring are engaged, wherein said front end of said socket is protruded from said wrench for the predetermined distance when said retaining groove matches said retaining ring.

* * * * *